US006675751B1

(12) United States Patent
Megli et al.

(10) Patent No.: US 6,675,751 B1
(45) Date of Patent: Jan. 13, 2004

(54) TWO-MASS BI-DIRECTIONAL HYDRAULIC DAMPER

(75) Inventors: Thomas William Megli, Dearborn, MI (US); Philip Thomas Koneda, Novi, MI (US); Stephen John Agdomy, Ypsilanti, MI (US); Yan Wang, Ann Arbor, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/249,051

(22) Filed: Mar. 12, 2003

(51) Int. Cl.[7] ..... F01L 9/02

(52) U.S. Cl. ..... 123/90.12; 123/90.11; 123/90.15; 123/90.16; 123/90.46; 123/90.49; 251/129.1; 92/85 B; 137/906

(58) Field of Search ..... 123/90.12, 90.11, 123/90.15, 90.16, 90.49, 90.52, 90.53, 90.55, 90.46; 251/129.01, 129.07, 129.1, 129.13, 129.16, 47, 129.15; 92/51–53, 130 C, 143, 85 B; 137/906

(56) References Cited

U.S. PATENT DOCUMENTS

| | | | | | |
|---|---|---|---|---|---|
| 3,887,019 | A | | 6/1975 | Reynolds et al. | 173/134 |
| 4,883,025 | A | | 11/1989 | Richeson, Jr. | 123/90.11 |
| 5,275,136 | A | * | 1/1994 | Schechter et al. | 123/90.12 |
| 5,809,950 | A | * | 9/1998 | Letsche et al. | 123/90.12 |
| 5,832,883 | A | | 11/1998 | Bae | 123/90.11 |
| 6,076,490 | A | | 6/2000 | Esch et al. | 123/90.11 |
| 6,116,570 | A | | 9/2000 | Ulgatz et al. | 251/129.1 |
| 6,205,964 | B1 | | 3/2001 | Maisch et al. | 123/90.11 |
| 6,412,457 | B1 | * | 7/2002 | Vorih et al. | 123/90.12 |
| 6,550,433 | B2 | * | 4/2003 | Vorih et al. | 123/90.15 |

* cited by examiner

*Primary Examiner*—Thomas Denion
*Assistant Examiner*—Kyle Riddle

(57) ABSTRACT

A hydraulic damper for an automotive engine electromechanical cylinder valve 20 is provided. The hydraulic damper includes an inner piston 130 which is slidably mounted within an outer piston 110. The outer piston is slidably mounted within an interior hydraulic filled cavity 82 of a damper body 80. Movement of the valve body 20 along extreme positions causes the inner piston 130 to move the outer piston 110 within the interior cavity 82 to effectuate hydraulic damping of the valve body 20.

17 Claims, 5 Drawing Sheets

TWO-MASS BI-DIRECTIONAL HYDRAULIC DAMPER

BACKGROUND OF INVENTION

The present invention relates to a hydraulic damper for an electromechanical valve, and in particular to a hydraulic damper that can provide relatively soft seating of an engine valve on an engine valve seat.

With a conventional mechanical engine valve train system, the profile of the cam not only controls the valve opening and closing events, but it also decelerates the valve as it approaches either a fully open or fully closed position. This is especially important during valve closing, since it prevents the valve from pounding against its seat which can cause noise and adversely affect durability. One of the significant challenges with electromechanical valve actuation systems is to replicate this "soft landing" feature repeatably over all operating conditions and at low cost.

Prior to the present invention many electromechanical valves required feedback control systems with precision position sensors to control the closing of the valve. The feedback control systems utilized complex algorithms which were highly nonlinear. The systems also required a complex structure and in many instances had to be adaptive or have interactive learning control schemes to compensate for changes in the electromechanical valve characteristics over the lifetime and operating conditions of an engine.

It is desired to provide a hydraulic damper useful in electromechanical valves which does not require costly controllers or the utilization of position sensors for proper operation.

SUMMARY OF INVENTION

The present invention provides a hydraulic damper for electromechanical valves utilized in internal combustion engines. In a preferred embodiment, the present invention provides a damper with a main body and a hydraulic filled interior cavity. The main body has aligned openings intersecting the interior cavity. The aligned openings provide passage for a valve stem which is operatively associated with the valve body.

An outer piston is slidably mounted within the damper main body interior cavity. The outer piston has its own interior hydraulic filled cavity. The hydraulic filled cavity of the outer piston also has aligned openings for passage of the stem therethrough. An inner piston is connected with the valve stem within the outer piston cavity. The inner piston is slidably mounted within the outer piston interior cavity. When urged toward a position proximate to one of the outer piston's aligned openings, the inner piston will move the outer piston resulting in a very high damping force and extra moving mass near the end of travel of the stem. This high damping portion provides a low valve stem velocity when the valve is going towards its seated closed position.

It is an advantage of the present invention to provide a hydraulic damper which provides very low valve speeds towards an extreme end of the valve's movement towards closure.

Other advantages of the present invention will become more apparent to those skilled in the art as the invention is further revealed in the accompanying drawings and detailed description.

DETAILED DESCRIPTION

Figure 1:
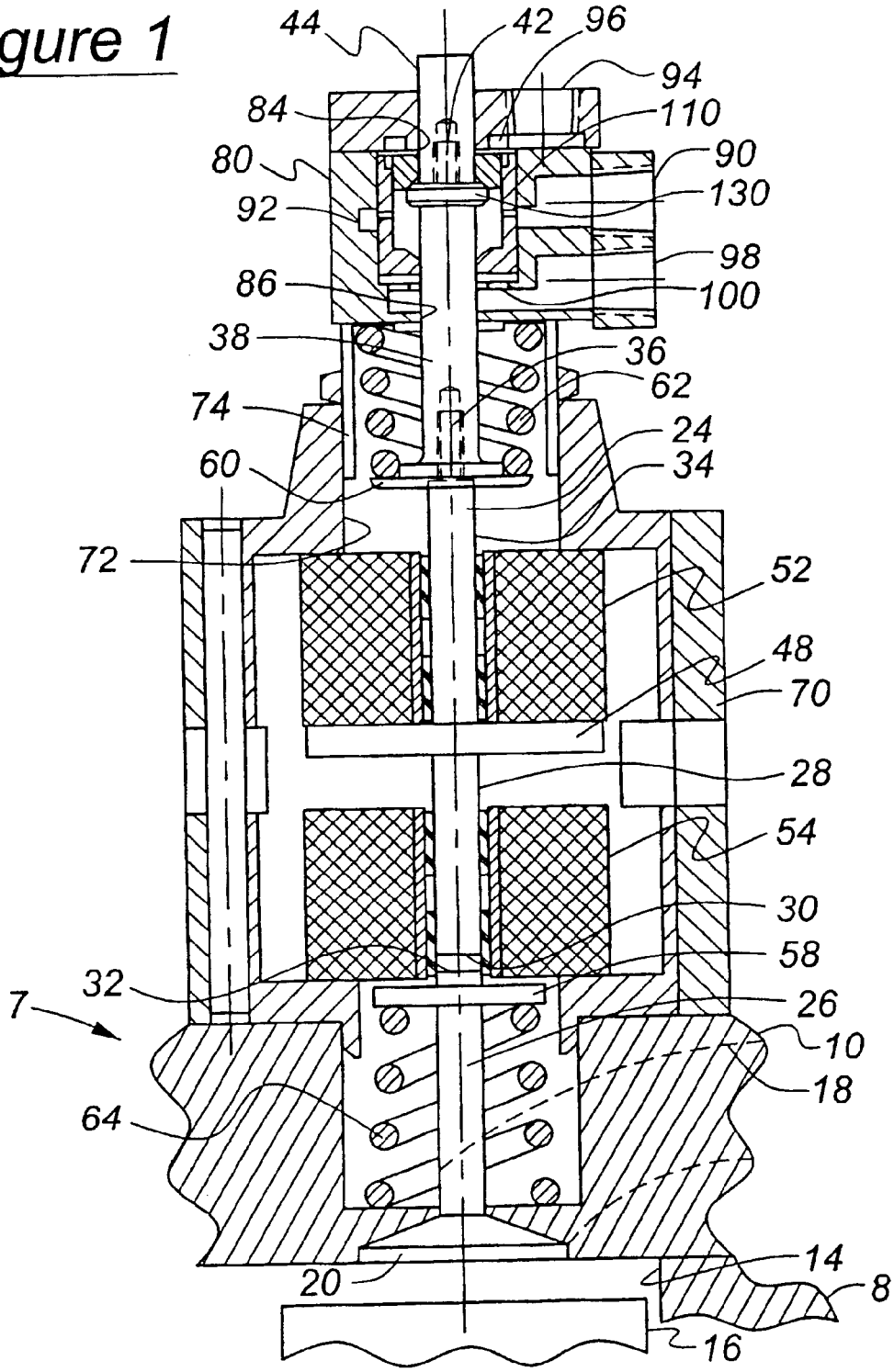
FIG. 1 is a side elevational view of an electro mechanical valve utilizing a fluid damper according to the present invention shown in section with the valve being in the fully closed position.

Connected on the stem 24 between the mid portion 28 and upper mid portion 34 is an armature 48. Surrounding the stem 24 above the armature 48 is a first electromagnetic coil 52. When activated, the first coil 52 urges the armature 48 in an upper first direction. Juxtaposed from the first coil by the armature 48 is a second electromagnetic coil 54. The second coil 54 urges the armature in a second downward direction opposite the direction of urging by the upper coil 52.

The valve body 20 is connected with a multiple part valve stem 24. The valve stem 24 has a lower portion 26. Separated from the lower portion 26 is a valve stem mid portion 28. The valve stem mid portion 28 has a lower end 30 which is gapped away from an upper end 32 of the lower portion 26. This gap between the lower end 30 and upper end 32 provides lash clearance for the valve stem 24.

Fixably connected to the mid-portion 28 is an upper mid portion 34. The upper mid portion 34 has a head 36 which is fixably connected within a lower damper portion 38 of the stem. A threaded connection is shown, however other types of connections are not excluded. Lower damper portion 38 of the stem 24 has a shoulder 40. The lower damper portion 38 also has a head 42 which is fixably connected with a top half portion 44 of the stem (FIG. 6).

Connected on the stem 24 between the lower portion 26 and mid portion 28 is an armature 48. Surrounding the stem 24 above the armature 48 is a first electromagnetic coil 52. When activated, the first coil 52 urges the armature 48 in an upper first direction. Juxtaposed from the first coil by the armature 48 is a second electromagnetic coil 54. The second coil 54 urges the armature in a second downward direction opposite the direction of urging by the upper coil 52.

The stem lower portion 26 has fixably connected thereto a spring bracket 58. The lower damper portion of the stem has an integral spring bracket 60. A first coil spring 62 contacts the spring bracket 60 to urge the stem 24 in the second downward direction. A second spring 64 exerts itself against the spring bracket 58 to urge the stem 24 in its respective upper first direction.

Figure 4:
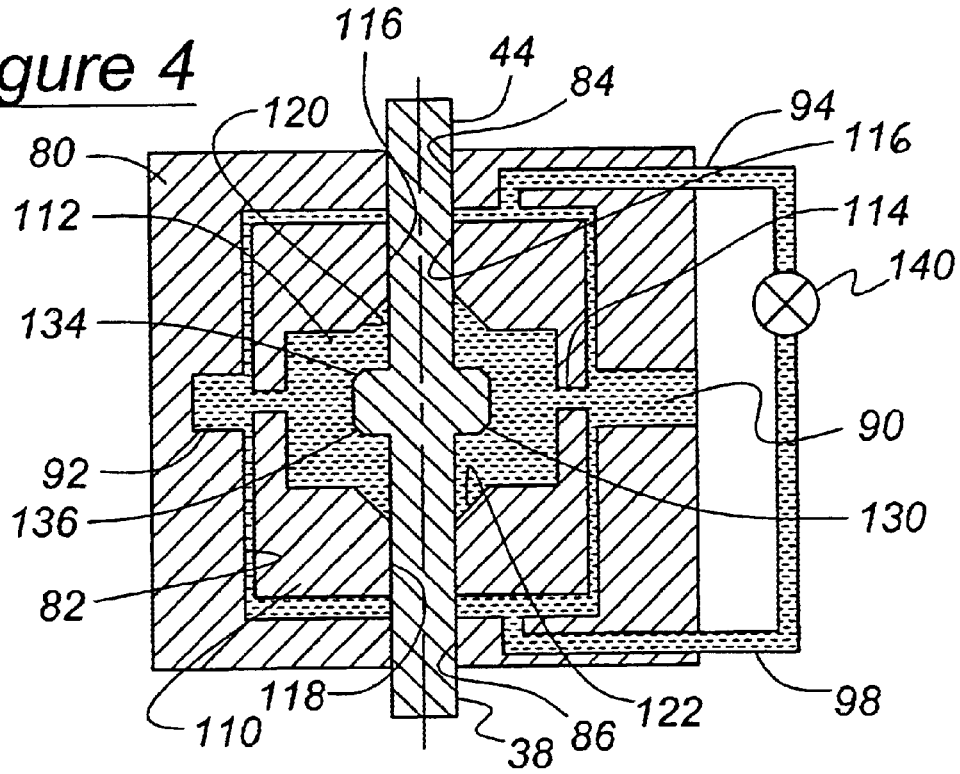
FIG. 4 is a schematic view of the damper shown in FIGS. 1–3.
Figure 6:
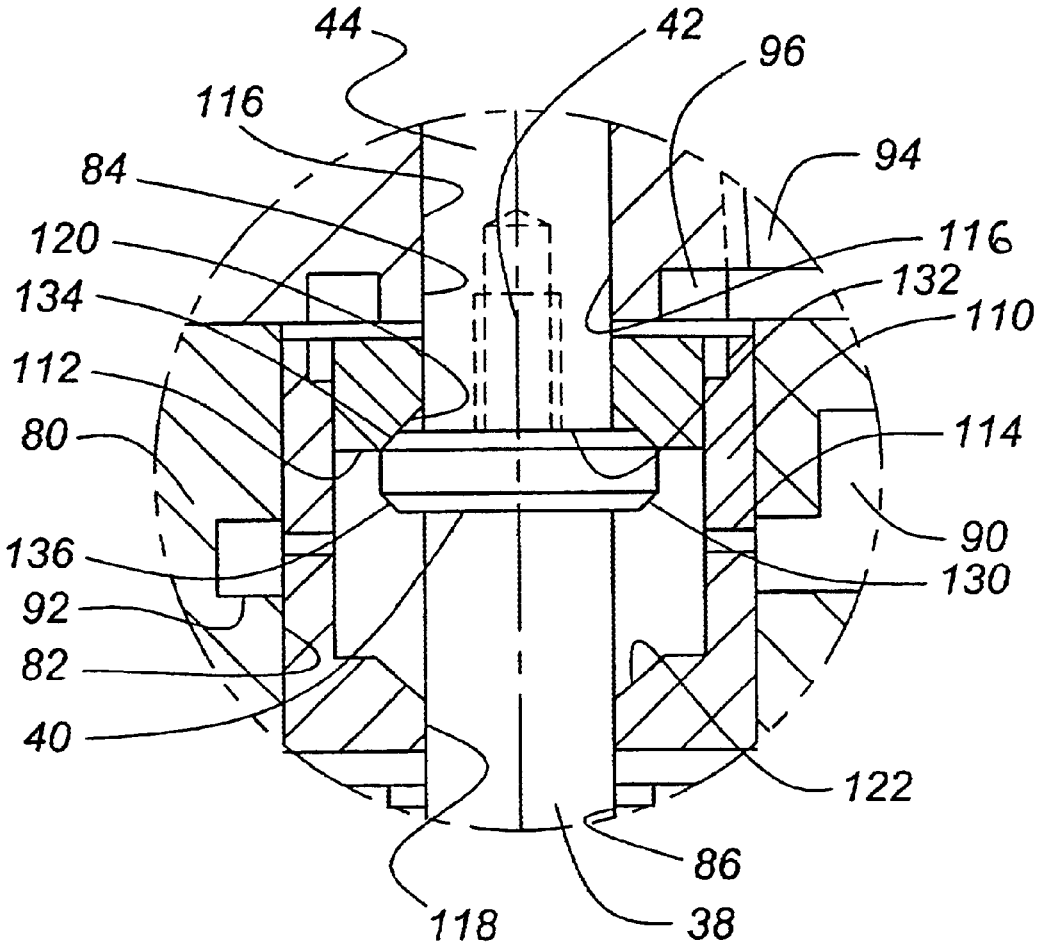
FIG. 6 is an enlargement of the damper portion of the electromechanical valve shown in FIGS. 1–3.

Referring additionally to FIGS. 4 and 6, the engine 7 is also supplied with an electromechanical valve housing 70. The valve housing 70 has an opening 72. Fixably connected within the opening 72 is a sleeve member 74. Fixably attached on top of sleeve member 74 is a damper body 80. The damper body 80 has an interior cavity 82. The interior cavity 82 is filled with hydraulic fluid. The damper body interior cavity has upper and lower aligned openings 84 and 86. The openings 84 and 86 allow for passage therethrough of valve stem top half portion 44 and lower damping portion 38 therethrough. The damper body 80 has a fluid supply inlet 90 which is inclusive of an annular supply path 92. The damper body also has a circulatory outlet 94. The circulatory outlet 94 is fluidly connected with an annular path 96 which is adjacent a top part of the interior cavity 82. The damper body 80 also has a lower circulatory outlet 98. The circulatory outlet 98 is fluidly connected with path 100.

Slidably mounted within the damper body interior cavity 82 is an outer piston 110. The outer piston 110 has a slight clearance with the interior cavity 82. The outer piston 110 has an interior hydraulic fluid cavity 112, and two side inlets 114. The side inlets 114 allow fluid communication with the interior cavity 82 of the valve body and with the fluid supply inlet 90. The outer piston 110 also has aligned upper and lower openings 116 and 11 8 which intersect the outer piston interior cavity 112. Openings 116 and 118 also allow for passage of the valve stem 24 through the outer piston 110. The outer piston 110 adjacent its upper and lower openings 116 and 118 has tapered valve seats 120 and 122.

Connected with the valve stem 24 and captured between the top half portion 44 and lower damper portion 38 is an inner piston 130. The inner piston 130 is captured between the aforementioned shoulder 40 of the lower damper portion and a shoulder 132 of the top half portion 44 of the stem. The inner piston has annular tapered upper and lower shoulders 134 and 136. The shoulders 134 and 136 ensure that the pistons will not interlock with each other under pressure loading. The inner piston is slidably mounted with respect to the outer piston interior cavity 112. When the inner piston 130 is towards an extreme direction with respect to the openings 116 and 118 of the outer piston, the inner piston 130 will urge the outer piston 110 to be carried along therewith.

Figure 2:
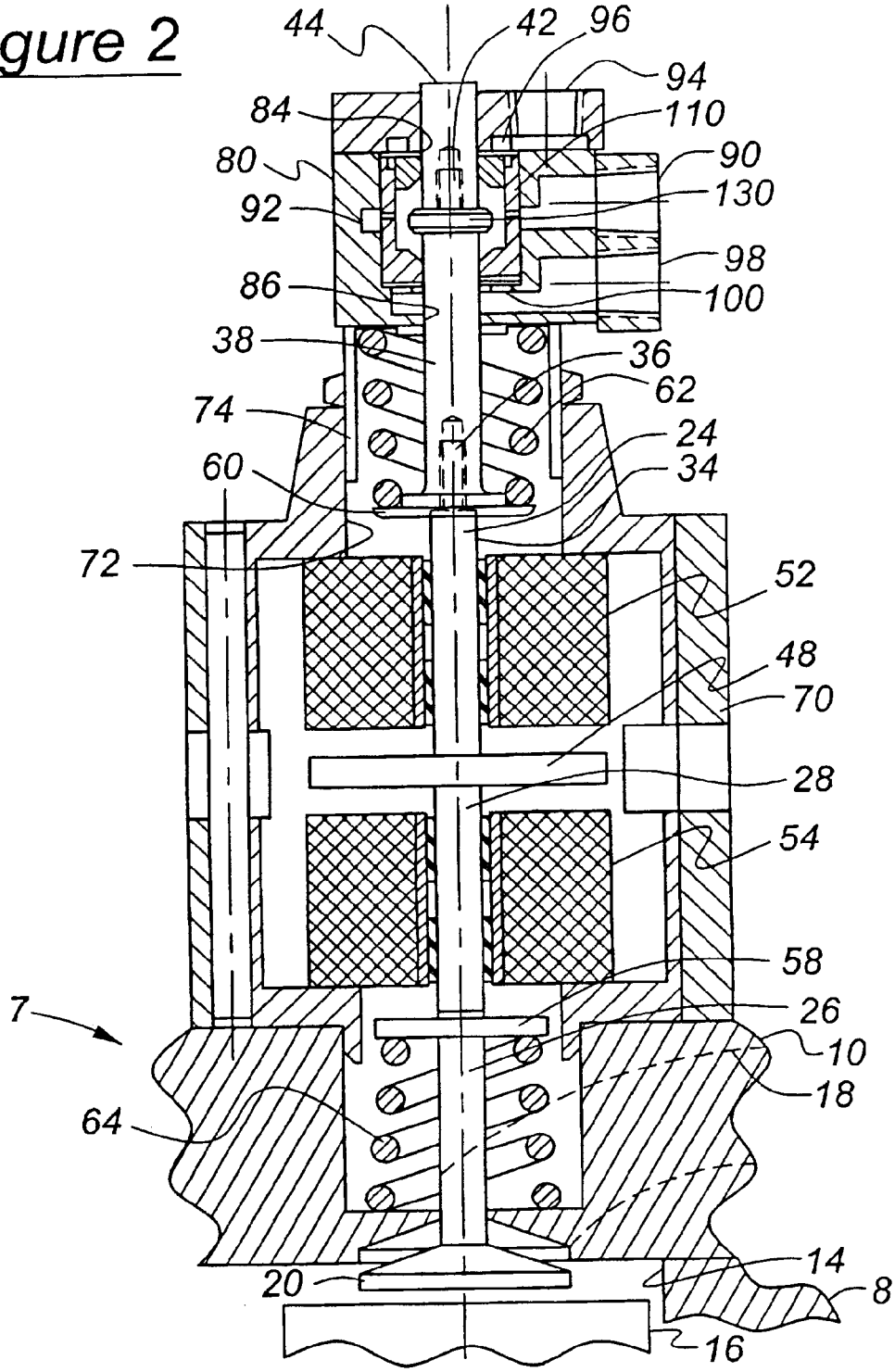
FIGS. 2 and 3 are views similar to FIG. 1 with the valve being shown in its partially open and fully open positions respectively.
Figure 3:
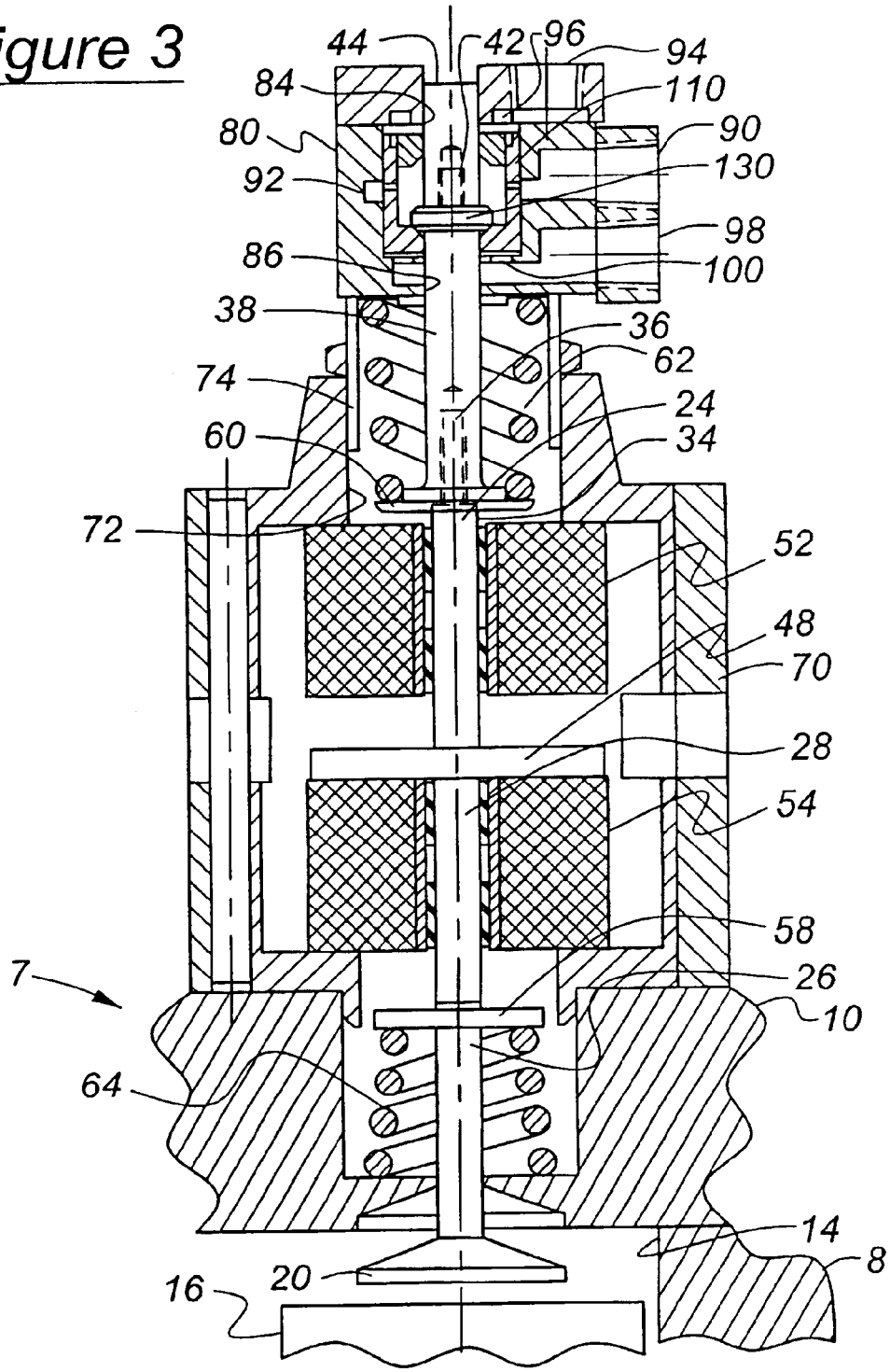

FIGS. 1–3 illustrate the valve body in three positions: fully closed, mid-point position and fully open. The mid-point position is the position that the valve body 20 will assume in the absence of electrical current to coils 52 and 54. The outer piston interior cavity 112 and the damper body interior cavity 82 are supplied with low pressure engine oil. During a typical valve transition, for example, from the open to closed position, the second coil 54 is turned off and the second spring 64 begins to push the spring bracket 58 upwards and therefore also push the valve stem mid portion 28 upwards. The inner piston 130 moves freely through the engine oil and its small diameter minimizes the mass and damping force, resulting from viscous shear of the hydraulic fluid, during most of the transition.

As the inner piston 130 approaches the upper valve seat 120, the first spring 62 compressive force begins to decelerate the armature 48 and the inner piston 130. The upper coil 52 is turned on to catch the armature 48 in the closed position. During the catching process the inner piston 130 begins to compress the oil at the top of the outer piston interior cavity 112 increasing the oil pressure in this cavity. This high pressure oil begins to exert a force against the outer piston 110 moving the outer piston upwards. The outer piston 110 then begins to squeeze oil through the diametral clearance between the outer piston 110 and the damper body interior chamber. The above-noted movement of the outer piston 110 creates a damping force due to the pressure differential between the top and bottom of the outer piston 110.

The outer piston 110 adds both mass and damping force which further decelerates the movement of the valve stem 24 (and accordingly the valve body 20) and armature 48 to a low terminal velocity prior to impact. Note that the relative velocity between the inner 130 and outer 110 pistons during impact should be very small due to the squeeze film nature of the operation. In other words, as the inner piston 130 gets closer to the outer piston 110, it provides a progressive increase in oil pressure to begin pushing the outer piston 110 upward.

The relative travel of the inner piston 130 within the outer piston 110 is smaller than the total armature 48 travel to ensure soft seating of both the valve body 20 and the armature 48. The armature 48 is seated against the first coil 52 (FIG. 1). The distance between the total armature 48 travel and the relative travel between the inner piston 130 within the outer piston 110 is determined by the maximum value for the valve body 20 lash. The above ensures that the inner piston 130 will pick up the outer piston 110 such that the system will reach a roughly constant and low velocity prior to the seating of the valve body 20 under all lash conditions. The above effectively replicates the lash compensation provided by camshaft ramps in conventional valve train designs.

With the damper of the present invention the coil control scheme during normal operation is a simple open loop control scheme wherein one coil is first released and after a short predetermined delay the other coil is energized to produce a saturation force which catches the armature 48 in the proper position. Precision control of the coil current as a function of distance traveled is not required, significantly simplifying the control requirements for motion. Once the armature 48 is stopped, the current in the catching coil is reduced to a low holding current level. The catching coil can be supplied with higher current so that the magnetic force produced is saturated when landing of the armature 48 occurs. The magnetic force saturation provides a safety factor for catching armature 48 and the valve body 20 in the proper position resulting in a robust repeatable and reliable system for controlling valve landing. Positional sensing is no longer required because the armature 48 motion control near the landing point (as described in detail later) is primarily determined by the magnetic saturation force, the spring constant of springs 62 and 64, valve lift and damper design characteristics.

In many prior electromagnetic valves, excess catching current resulted in unacceptably high impact velocities between the engine valve and its seat and the armature against the coil. The current could be reduced to reduce impact velocities in prior valves but that increased the chances of losing the valve, a common problem with many prior electromagnetic valve systems.

By virtue of the two mass aspect of the present inventive damper, the maximum damping during closing or opening which occurs at some time during the last 10% of valve travel is typically at least 200 times as great as a damping that occurs at midpoint travel of the valve stem 24. This is because there is very little hydraulic damping imposed upon the system when the inner piston 130 is traveling between its extreme positions with respect to the outer piston interior cavity 112. Primary indications have indicated ratios of a hydraulic damping of 400 Newtons during the extreme positions of the travel of the stem versus a midpoint damping of only 1 Newton. Also, since midpoint damping is substantially reduced, current draw by the coils is also reduced. Reduced damping during mid travel also increases valve speed allowing closing/opening for faster engine rotational speeds.

DETAILED THEORY OF OPERATION

The relationship between-damper and actuator design parameters, and contact velocity may be expressed in simple form by considering the magnetic force $F_{mag}$, spring force $K_sL$, and damping force $F_{damp}$ provided by the outer piston 110 near the landing point. When the armature 48 is near the face of the electromagnet, the electromagnet can be easily saturated with low current levels to provide a constant magnetic force. The damper and armature velocity (v) will then, to a first approximation, converge to a point where the velocity is roughly constant, and the damping force offsets the net pull-in force, which is the difference between the magnetic attractive force and the opposing spring force:

$$F_{mag}-K,L=F_{damp}(v) \tag{1}$$

The damping force is calculated from the pressure differential across the outer damper piston 110 which is approximated by assuming orifice flow through the oil bypass circuit. The orifice flow rate is related to the piston area $A_{pist}$, orifice area $A_{orif}$, armature velocity v, and pressure drop $\Delta P$ according to:

$$Q = vA_{pist} = C_d A_{orifice}\sqrt{\frac{2(\Delta P)}{\rho}} \tag{2}$$

The damping force as a function of velocity v is then:

$$F_{domp} = A_{pist}\Delta P = \frac{\rho}{2}\left(\frac{V_{pist}A_{pist}}{C_d A_{orif}}\right)^2 A_{pist} \tag{3}$$

The piston area can be expressed in terms of the guide stem diameter d and major diameter D as:

$$A_{pist} = \frac{\pi(D_{pist}^2 - d^2)}{4} \tag{4}$$

Additionally, the orifice has a minimum area that is the circumferential clearance between the piston and damper body, and is defined by the diameter D and the diametral clearance $\delta$:

$$A_{orif} = \frac{\pi D\delta}{2} \tag{5}$$

Substituting Equations (3), (4), and (5) into Equation (1) gives the approximate terminal velocity v:

$$v = \left[\frac{(F_{mag} - K, L)32}{\pi\rho(D^2 - d^2)^3}\right]^{1/2} C_d\delta D \tag{6}$$

where, following the method outlined in [Merritt, Hydraulic Control Systems], the discharge coefficient is given by:

$$C_d = \frac{C_{dmax}Re^{1/2}}{\sqrt{Re_t}} \quad \text{for } Re < Re_t \tag{7}$$

and $$C_d = C_{dmax} \quad \text{for } Re = Re_t$$

Typical values for maximum discharge coefficient and transition Reynolds number are $C_{dmax}$=0.61 and $Re_t$=25. Note that Re is the orifice Reynolds number, which can be written in terms of oil density $\rho$, viscosity $\mu$, and damper diameters as:

$$Re = \frac{\rho v(D^2 - d^2)}{2\mu D} \tag{8}$$

Figure 5:
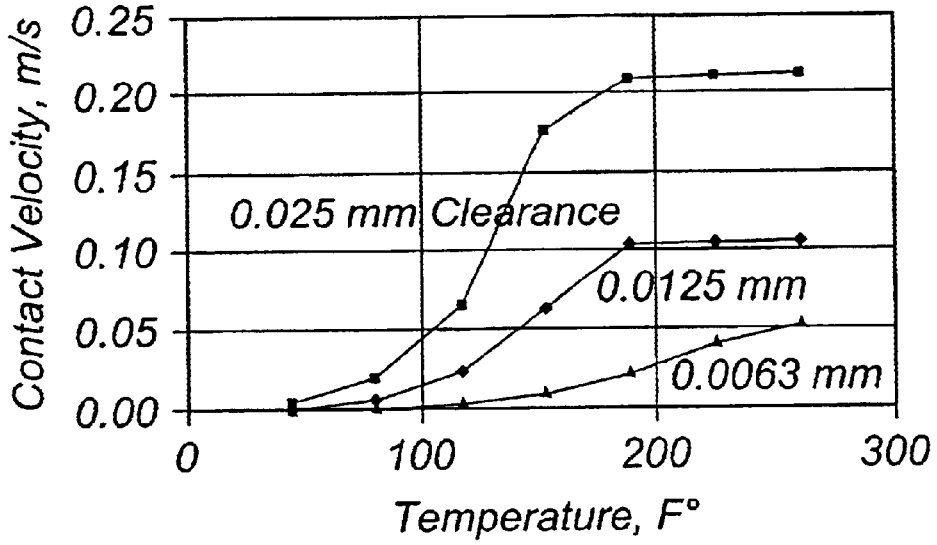
FIG. 5 is a graphic illustration illustrating the relationship between contact velocity and hydraulic fluid temperature for different diametric clearances.

FIG. 5 illustrates the contact velocity predicted from Equation (6) for a 15 mm outer piston diameter (D), magnetic saturation force of about 1000N, spring constant of 158 N/mm, valve lift of 8 mm, and 6 mm stem diameter (d). Note that the Reynolds number dependence of the discharge coefficient implies temperature dependence due to changes in the oil viscosity. Also note that for a reasonable diametral clearance of 0.025 mm, the damper is able to achieve low contact velocity at lower temperatures; however, the contact velocity increases above 0.1 m/s at a temperature of about 120 F. The typical solution given reasonable machining tolerances for clearances is to increase the piston diameter to further reduce the contact velocity at elevated oil temperatures. With a single mass damper, the increase in diameter would increase mid-travel energy loss and transition time, an undesired outcome. This is in contrast to the two mass damper design, where the large outer diameter piston only has a significant effect near the end of the transition. Improved performance can be achieved with smaller clearances.

Turning to FIG. 4, if increased control is desired, the circulatory outlets 94 and 98 can be connected to provide a bypass circuit having a variable valve 140 connected therein. The variable valve 1 40 can be controlled by a signal given by the engine controller to open or close the valve or in an on-off fashion or in a variable fashion to therefore fit the pressure above or below the outer piston 110 to achieve greater regulation in the damping. When the valve 140 is closed, damping will be achieved in the passive manner aforedescribed.

The present invention has been described in various embodiments. It will be apparent to those skilled in the art of the various modifications and changes which can be made to the present invention without departing from the spirit or scope of the invention as it is encompassed by the following claims.

What is claimed is:

1. A hydraulic damper for an electromechanical valve, said electromechanical valve having a valve body operatively associated with a stem, said damper comprising:

a main body with an interior hydraulic fluid filled cavity, said main body having openings intersecting said cavity for passage of said stem through said openings;

an outer piston slidably mounted within said main body cavity, said outer piston having an interior hydraulic fluid filled cavity with openings for passage of said stem therethrough; and an inner piston connected with said stem, with said piston being slidably mounted within said outer piston cavity for moving said outer piston when said inner piston is urged toward a position proximate one of said outer piston openings.

2. The hydraulic damper as described in claim 1 having a bypass circuit fluidly communicating fluid from one side of said outer piston to the other side of said outer piston through a path external to said main body interior cavity.

3. The hydraulic damper as described in claim 2 wherein said bypass circuit has a variable valve connected therein.

4. The hydraulic damper as described in claim 1 wherein a clearance between said main body interior cavity and said outer piston is unsealed.

5. The hydraulic damper as described in claim 1 wherein said outer piston interior cavity provides a tapered seat in at least one direction for said inner piston.

6. The hydraulic damper as described in claim 5 wherein said outer piston interior cavity has tapered seats for both directions of said inner piston.

7. The hydraulic damper as described in claim 1 wherein said outer piston interior cavity has a fluid communication with said main body interior cavity.

8. The hydraulic damper as described in claim 1 wherein said stem is a multiple part member having an upper portion and a lower portion and said inner piston is captured between said upper and lower portions of said stem.

9. A hydraulic damper for an electromechanical valve, said electromechanical valve having a valve body operatively associated with a stem, said damper comprising:

a main body with an interior hydraulic fluid filled cavity, said main body having openings intersecting said cavity for passage of said stem through said openings;

an outer piston slidably mounted within said main body cavity having clearance therewith, said outer piston having an interior hydraulic fluid filled cavity with upper and lower aligned openings for passage of said stem therethrough, said outer piston interior cavity having fluid communication with said interior cavity of said main body, and said outer piston interior cavity having a tapered seat adjacent said upper opening, and an inner piston connected with said stem within said outer piston interior cavity and being slidably mounted therein and said inner piston moving said outer piston when said inner piston is urged toward a position proximate one of said outer piston openings.

10. An electromechanical valve comprising:

a valve body connected with a valve stem;

an armature connected on said stem;

first and second coils juxtaposed by said armature for urging said armature in first and second respective directions;

first and second springs for urging said stem in said second and first directions respectively, a damper body having an interior hydraulic fluid filled cavity, said damper body having openings intersecting said cavity for passage of said stem through said openings;

an outer piston slidably mounted within said damper main body cavity, said outer piston having an interior hydraulic filled cavity with openings for passage of said stem therethrough; and an inner piston connected with said stem being slidably mounted within said outer piston cavity for moving said outer piston when urged toward a position proximate with respect to one of said outer piston openings.

11. An electromechanical valve as described in claim 10 having a multiple part stem having a first part connected with said valve body and being urged by said second spring to be in contact with a second part of said stem which is connected with said armature.

12. An internal combustion engine comprising:

an engine body having a cylinder with a reciprocating piston mounted therein with a passageway intersecting said cylinder;

a valve body for controlling fluid communication through said passageway with said cylinder;

a valve stem connected with said valve body;

an armature connected on said stem;

first and second coils juxtaposed by said armature for urging said armature in respective first and second directions;

first and second springs for biasing said armature in said respective second and first directions;

a damper main body with an interior hydraulic filled cavity, said damper main body having openings intersecting said main body cavity for passage of said stem through said openings;

an outer piston slidably mounted within said main body cavity having an interior hydraulic fluid filled cavity with openings for passage of said stem therethrough; and an inner piston connected with said stem being slidably mounted within said outer piston interior cavity for moving said outer piston when said inner piston is urged toward a position proximate to one of said outer piston aligned openings.

13. An electromechanical valve as described in claim 12, wherein said armature has first and second positions with respect to said first and second coils and wherein said distance between said first and second position of said first and second coils is greater than a distance between extreme positions of said inner piston within said outer piston cavity.

14. A method of hydraulically damping the closure of an electromechanical valve, said valve having a valve body having a first closed position and a second open position, said valve body having a stem with a connected armature and a first coil for urging said armature in a first direction to close said valve body, said stem passing through openings of a damper main body with a hydraulic fluid filled interior, and said damper body interior having a slidably mounted outer piston having a hydraulic fluid filled interior with openings to allow passage of said stem therethrough, and wherein said stem has a connected inner piston slidably mounted within said outer piston interior, said method comprising:

damping said valve stem by passage of said inner piston within said interior of said outer piston; and wherein upon said inner piston reaching a position proximate to said opening of said outer piston causing said outer piston to slide within said damper main body to further increase damping of said valve body closing.

15. A method as described in claim 14, wherein said coil is excited at a saturation current until after said valve body has reached said first position from said second position.

16. A method of hydraulically damping a electromechanical valve, said valve having a valve body having a first closed position and a second open position, said valve body having a stem operatively associated therewith, said method comprising:

connecting with said stem an armature; positioning on opposite sides of said armature first and second coils for urging said armature in a respective first direction to close said valve body and a second direction to open said valve body;

urging said stem through a passive hydraulic damper main body having a hydraulic fluid filled interior and aligned openings allowing passage of said stem therethrough, hydraulically damping said stem at a first given maximum damping during at least a portion of the last ten percent of travel of said stem when said valve body is moving from said second open position to said first closed position and hydraulically damping said stem at a second value 1/200 or less of said first value when said stem is at a midpoint of travel between said second and first positions.

17. A method of hydraulically damping an electromechanical valve as described in claim 16 further including hydraulically damping at said first maximum during at least a portion of the last ten percent of travel of said stem when said valve body is moving from said first closed position to a second open position and hydraulically damping of said stem at a third value 1/200 or less of said first value when said stem is at a midpoint of travel between said first and second positions.

* * * * *